United States Patent [19]

Duret

[11] Patent Number: 4,798,157

[45] Date of Patent: Jan. 17, 1989

[54] DROGUE ASSOCIATED WITH A GUIDANCE SYSTEM

[76] Inventor: Jean Duret, 27 rue de la Double Haie, 60300 Senlis, France

[21] Appl. No.: 945,059

[22] Filed: Jan. 30, 1987

[30] Foreign Application Priority Data

Apr. 2, 1985 [FR] France ..... 8504965

[51] Int. Cl.[4] ..... B63B 1/24

[52] U.S. Cl. ..... 114/253; 114/121; 114/122; 114/123; 114/246; 446/154

[58] Field of Search ..... 114/144 A, 144 R, 39, 114/56, 61, 121, 122, 123, 242, 253, 128, 246, 311; 446/153, 154, 155, 34, 31

[56] References Cited

U.S. PATENT DOCUMENTS

| | | | |
|---|---|---|---|
| 1,859,557 | 5/1932 | Edgar | 446/154 |
| 1,893,149 | 1/1933 | Picco | 244/3 |
| 2,834,152 | 5/1958 | Lambert | 446/154 |
| 3,008,442 | 11/1961 | Russell | 114/128 |
| 3,745,958 | 7/1973 | Nelson | 114/253 |
| 3,762,353 | 10/1973 | Shutt | 114/39 |
| 3,793,761 | 2/1974 | Bonham | 446/154 |
| 3,870,004 | 3/1975 | Bailey | 114/39 |
| 3,953,905 | 5/1976 | Paitson | 114/253 |
| 4,067,280 | 1/1978 | Serfess | 114/128 |
| 4,345,535 | 8/1982 | Ross | 114/128 |

FOREIGN PATENT DOCUMENTS

| | | | |
|---|---|---|---|
| 1494784 | 9/1967 | France | 114/39 |
| 2519311 | 7/1983 | France | 114/39 |
| 2526749 | 11/1983 | France | 114/39 |

*Primary Examiner*—Joseph F. Peters, Jr.
*Assistant Examiner*—C. T. Bartz
*Attorney, Agent, or Firm*—Fleit, Jacobson, Cohn & Price

[57] ABSTRACT

The drogue (1) has a steering system (8) which may be assisted by a rudder (4). The drogue is steered by varying the towing angle by applying a longitudinal differential force to the rope (6). The drogue is highly stable. It is capable of effectively countering the heeling torque of a boat (5). It may also be used for performing experiments at a distance from acoustic interference from the towing vessel. It may also be used for steering the course of a free balloon above the waves within a downwind sector.

7 Claims, 3 Drawing Sheets

DROGUE ASSOCIATED WITH A GUIDANCE SYSTEM

The present invention relates to a drogue associated with a simple and accurate guidance system. There are numerous applications for such a drogue. In particular, it may constitute an anti-heeling system for sailboats.

Several variants of drogues known as "paravanes" for mine-sweeping at sea have been developed, as designed by Captain Burney in 1917 and including the Otter apparatus which has been used. These drogues rely on a disposition of surfaces which, by virtue of their incidence in the water, tend to move away from the side of the towing vessel. On the same principle, numerous studies have shown the advantage of having such surfaces to the windward of a sailboat and connected by cables or arms to the rigging thereof. This arrangement provides an effective counter to the heeling torque on the boat. However, such drogues have not been used because they lack a guidance system worthy of the name.

The design and the steering system of the invention enable such drogue surfaces to be used. A drogue in accordance with the invention is constituted by a float with a centerboard which is towed and guided from a towing unit such as a boat, via a flexible rope or cable.

Its design satisfies the criteria for static stability of a moving body about its center of gravity. Thus, the drogue returns to its equilibrium position if it is displaced therefrom. The rope running from the owing boat is inserted in the groove of a wheel which may be circular or otherwise and which is fixed to the drogue, and then returns to the towing boat. While the drogue is being towed, it can be steered at will by means of differential longitudinal action on the two ends of the rope.

In a first variant, the wheel 8 is free to rotate about its axis through a limited angle and performs steering by means of steering gear to steer the drogue in the same direction as the wheel.

In a second variant, when the drogue 1 does not include steering 4, rotation of the wheel 8 is linked to steer the drogue either directly or else by means of a mechanical transmission.

The differential longitudinal action of the rope on the wheel may be performed manually or it may be linked to the heel angle of the boat.

The invention will be better understood from reading the following description describing several implementations thereof given by way of non-limiting example. The description refers to the accompanying drawings, in which:

FIG. 1 is a diagram showing a drogue associated with a rudder and towed by a sailboat. For reasons of clarity, the figure is not exactly to scale.

FIG. *2a* is a plan view showing the steering gear for operating the rudder.

FIG. *2b* is a diagram showing the applicable forces.

FIG. *2c* is a diagram showing variation in the hydrodynamic resultant R as a function of the angle of incidence i.

FIGS. *6a* and *6b* are a side view and a plan view showing the disposition and the sector of possible routes for a lighter-than-air craft of the free balloon type associated with a drogue.

Figure 1:
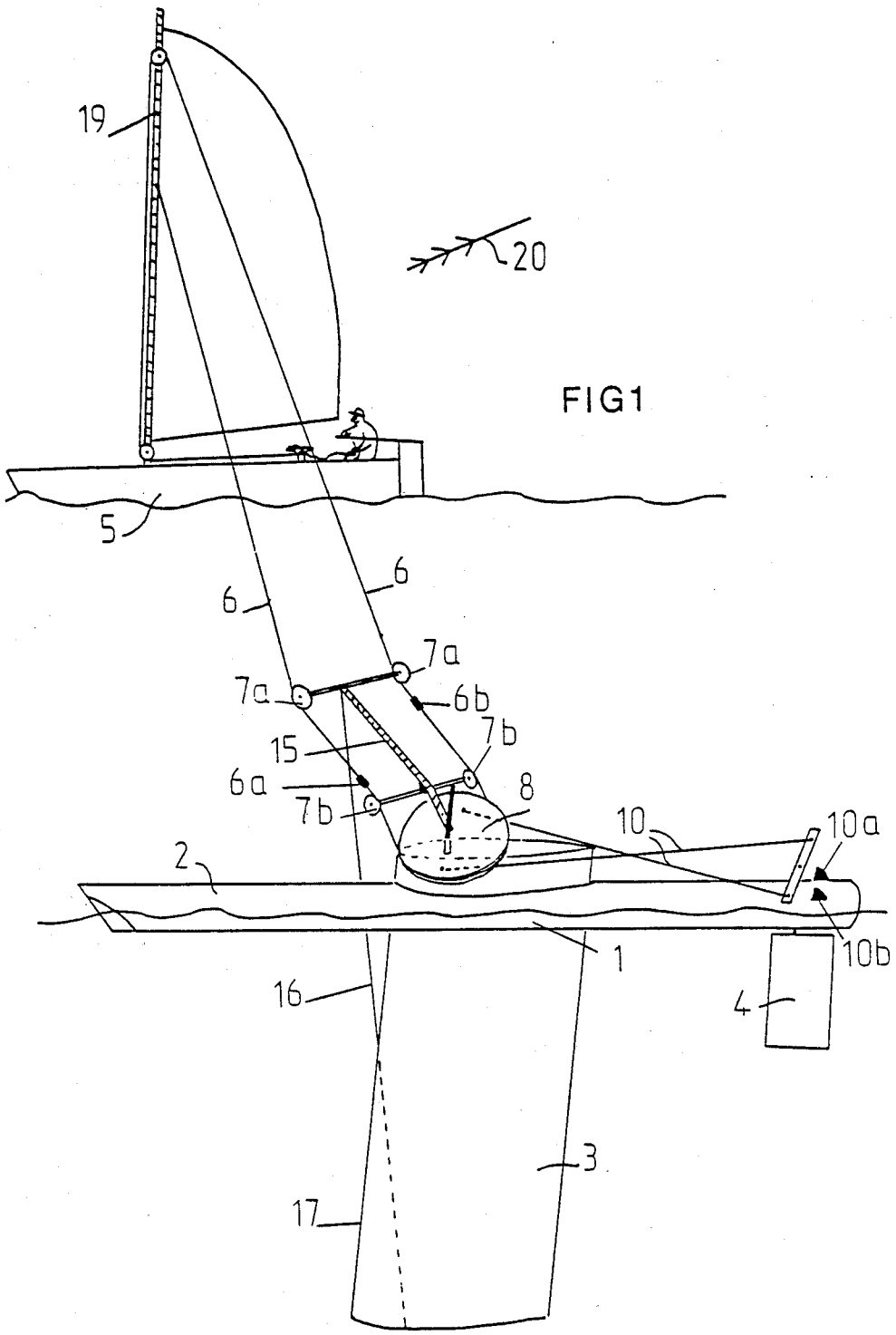
Figure 3:
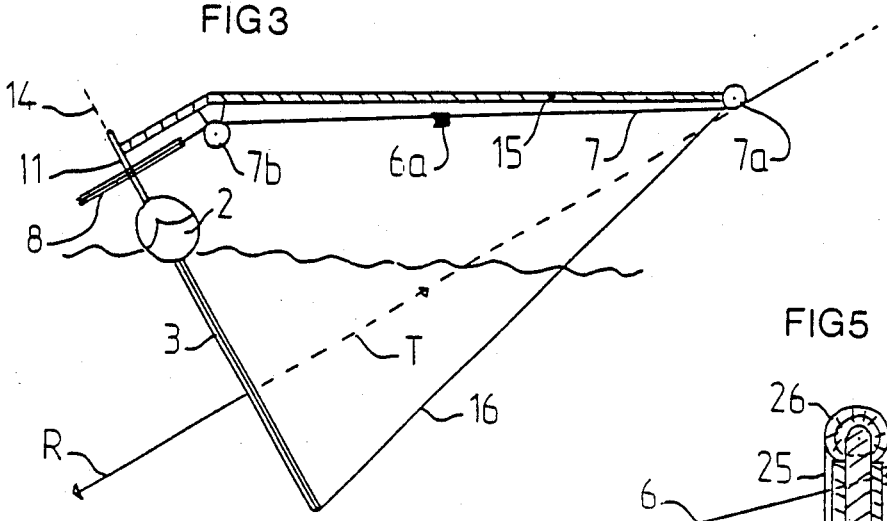
FIG. 3 is a section perpendicular to the roll axis for showing lateral stabilization of the drogue, and the disposition of the guide pulleys for the rope.

FIG. 1 shows the drogue 1 which is constituted by a float 2, a suitably streamlined centerboard 3, and steering means 4 constituted in this example by a rudder. The connection with the towing unit which is a sailboat 5 in this case is provided by means of a rope 6. The rope 6 is deflected by pulleys *7a* and *7b* and is engaged in a groove around a wheel 8, and is fixed in a rear portion thereof at a point 9 which does not affect the deflection of which the wheel is capable. The axis of rotation 11 of the wheel 8 coincides with the yaw axis 14 (see FIG. 3), and the deflection of the wheel on either side of the longitudinal axis 13 of the drogue 1 is limited by mechanical stops situated, for example, at 1O*a* and 10*b*. The wheel actuates steering gear 10 which acts on the rudder 4 in such a direction as to cause the drogue to follow the rotation of the wheel 8. This steering gear may be constituted by means of two crossed lengths of cord 10 which actuate a yoke fixed to the rudder 4. It could alternatively be constituted by connecting rods, etc. . . .

Figure 4:
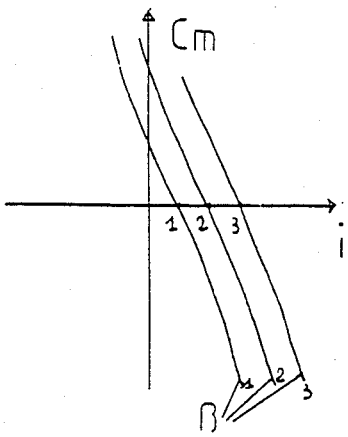
FIG. 4 is a graph showing variation in the moment coefficient Cm as a function of the angle of incidence i.

In order to verify that the drogue satisfies static stability criteria, three mutually perpendicular axes related to the drogue 1 may be associated therewith, and about these axes:

longitudinal stability about the pitch axis 12 (FIG. *2a*) is provided by means of the float 2;

lateral stability about the roll axis 13 (FIG. 3) is provided when the traction vector T of the rope 6 is opposite to the hydrodynamic resultant force R. This condition is achieved by means of an arm 15 which is free to rotate about the axis 11, which is associated with the pulleys *7a* and *7b*, and which is subjected at its end to the action of an immersed length of cord 16. Alternatively, the structure of the arm 15 and the axis 11 could be reinforced so that the immersed length of cord 16 could be omitted. The disposition of the arm 15 also makes it easy to pass the rope 6 from one side of the float 2 to the other;

stability about the yaw axis 14 (see FIG. *2b*) is provided by an arrangement in which the traction vector T is applied to the chord of the centerboard profile ahead of a point F defined as being the focus of the centerboard profile. From FIG. *2b*, it can be seen that the moments are in equilibrium when $M_tR+M^tT=0$. The value of the resultant force R at speed Vo is: $R=(\frac{1}{2})\rho SVo^2Cr$ and $M^tR=(\frac{1}{2})\rho SVo^2Crd$, where $\rho=$ the density of the fluid, S = the reference area of the plane of the centerboard 1, Cr = a form coefficient depending on the shape of the profile, and d = the distance between the perpendicular projection of R on the chord of the centerboard profile and the leading edge 17 thereof. Putting $Cr\times d=Cm\times 1$, where $1=$the arbitrary length of the chord of the centerboard profile, then $M^tR=(\frac{1}{2})\rho SVo^2Cml$. Tests have made it possible to draw the graph of FIG. 4 of $Cm=f(i)$ showing variation in the moment coefficient Cm as a function of the angle of incidence i of the centerboard profile. By convention negative coefficients Cm end to reduce i and vice versa. Thus, the directional stability of the drogue 1 is related to the value of the ratio (dCm/di) which exists at each value of incidence i. It has been shown in aerodynamics that stability, i.e. negative (dCm/di) requires the force equilibrium point 14 to lie on the chord of the centerboard profile ahead of a point F referred to as the focus. Tests have shown that in general $F \approx 0.3 \times 1$ from the leading edge 17. This condition is satisfied by placing the axis of the wheel 8 (and optionally of the immersed length of cord 16) at a position on the chord of the centerboard profile such that the point of application of the tension forces T lies ahead of the focus F. It may be observed that placing a rudder 4 at the stern portion of the drogue 1 causes the position of the focus F to move astern and thus increases static stability. The rudder 4 acts to steer the drogue in the direction given by the wheel 8.

Figure 2A:
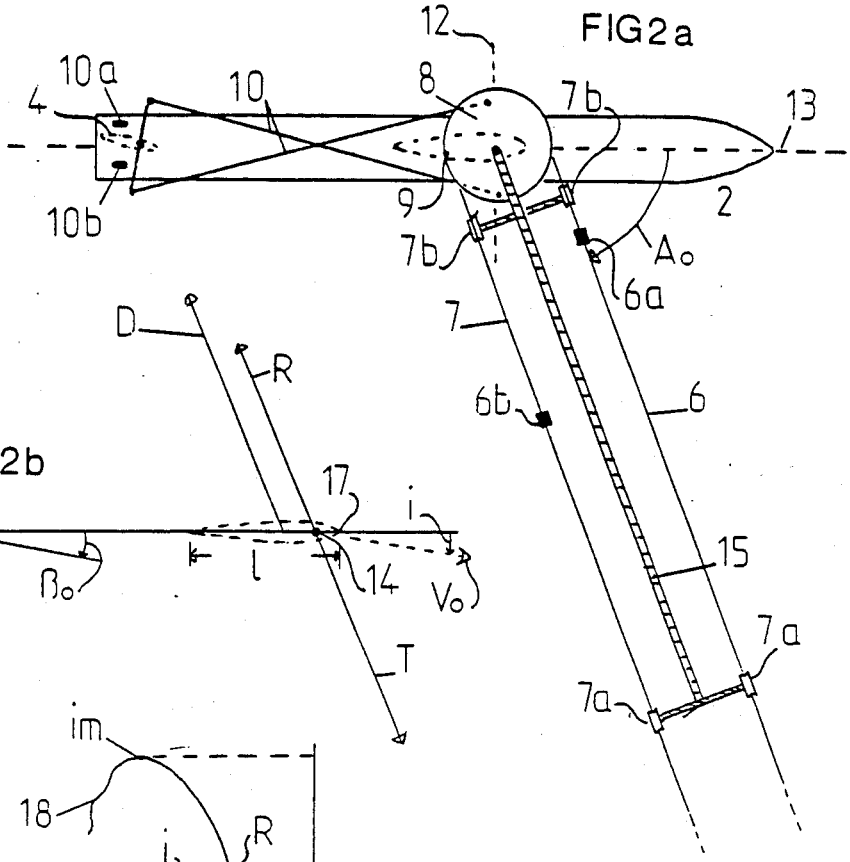
Figure 2B:
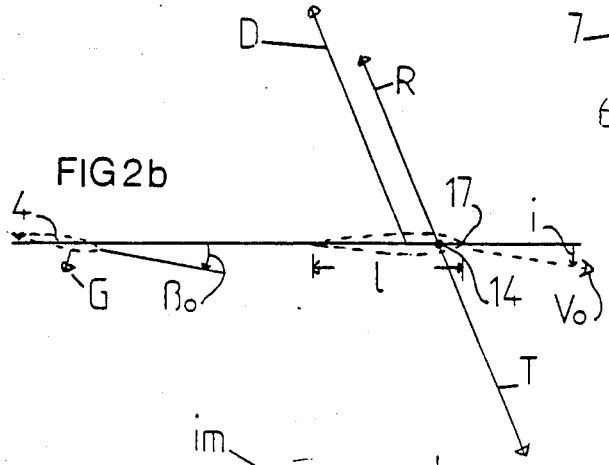
Figure 2C:
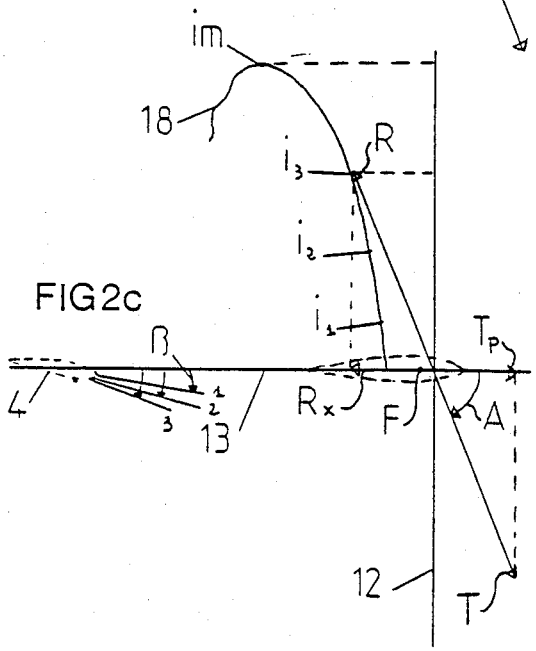

When the drogue 1 is moving through water at a speed Vo, it can be seen from the diagram of FIG. 26 that the tension in the rope 6 (a vector T) opposes the resultant of the hydrodynamic forces (a vector R). In equilibrium, the component $\overline{Tp}$ of T along the roll axis 13 is exactly opposite to the component $\overline{Rx}$ of R along the same axis. When T is no longer exactly opposite to R, equilibrium is broken: $\overline{Tp}$ is no longer exactly equal to $\overline{Rx}$, and the speed of the drogue increases or reduces until equilibrium is again found at a new angle A (see FIG. 2*c*) or at a new speed Vo. The vector T at angle A to the roll axis 13 opposes the resultant R which describes a polar curve 18 for different values of the incidence i of the centerboard profile. A symmetrical polar curve obtains when T is on the opposite side. It is undesirable to exceed an incidence im corresponding to the maximum value of the projection of R on the pitch axis 12. This condition is achieved by limiting the deflection of the rope 6 on either side of neutral by mechanical stops situated at 6*a* and 6*b*, for example. Thus, under stabilized conditions, the angle A cannot exceed the value Am which corresponds substantially to the incidence im.

When the wheel 8 acts on the drogue 1 by means of the rudder 4, the effect of the rudder is to pivot the drogue 1 about the yaw axis 14. Thus, any rotation in the direction of the wheel 8 through some angle A rotates the rudder 4 and the drogue 1 turns towards the value of angle A as selected by the longitudinal positioning of the ends of the rope 6. Since the wheel 8 is directly fixed to the rope 6 any deflection of the drogue 1 from its course in a given direction determines the relative rotation of the wheel 8 which then rotates the rudder 4 to cause the drogue 1 to return towards the initial angle A. This gives rise to a high degree of dynamic stability.

In the second variant, the drogue 1 does not have a rudder and the wheel 8 is disposed in the same manner as before except that rotation of the wheel 8 is transmitted to the drogue 1 either directly or else by means of a mechanical transmission. The wheel 8 points the drogue 1 in the direction selected by the rope 6. This action is less flexible and is limited to small drogues 1.

Figure 5:
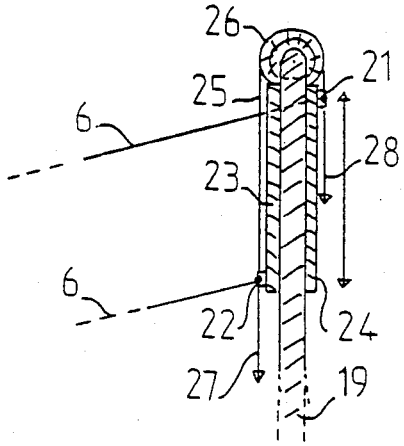
FIG. 5 is a view of the top portion of the mast of the towing boat showing a device for varying the height of the rope support.

A drogue 1 in accordance with the invention can effectively counter the heeling torque of a sailboat 5 when the rope 6 is positioned at different heights up the mast 19 (see FIG. 1). When the sailboat 5 heels under the effect of wind 20, the higher portion 6 of the rope on the mast 19 rotates the wheel 8 in a direction which increases the incidence i, and the resultant R follows the curve 18 in FIG. 2*c*. The tension T which opposes R increases correspondingly and counters the heeling torque of the sailboat 5. In order to able to sail on both tacks, the sailboat 5 may be equipped with two similar drogues, one on each side thereof. However, a single drogue 1 may be used and may pass from one side of the boat to the other past the stern of the towing boat 5. For sailboats, it must be possible to swap over the positioning of the rope 6 on the mast 19 in order to react in the proper direction to heeling. Thus, the supports 21 and 22 for the two portions of the rope 6 are disposed in vertical slides 23 and 24 fixed on either side of the mast 19 (see FIG. 5). These supports slide freely in their respective slideways. They are interconnected by a cord 25 of determined length which runs over a return pulley 26 at the top of the mast 19. Each of the supports 21 and 22 can thus alternate between a top position and a bottom position when a corresponding control lines 27 or 28 are actuated. In order for the device to operate in the proper direction, the top support should correspond to the portion of the rope 6 which goes to the rear of the wheel 8, and the relative heights of the supports 21 and 22 are swapped over when the drogue 1 is located astern of the boat 5.

A drogue 1 in accordance with the invention constitutes a support which is particularly suitable for performing experiments or research at sea. For example, in marine geophysics, the floats 2 of one or more drogues 1 may be fitted with various transmitting and receiving means. The small size, the lack of a propulsive propeller, the maneuverability, and the distance from the side of the towing vessel, all assist in enabling the drogue 1 to operate in zones having reduced acoustical interference due to the vessel. The best propagation conditions are thus obtained.

Figure 6A:
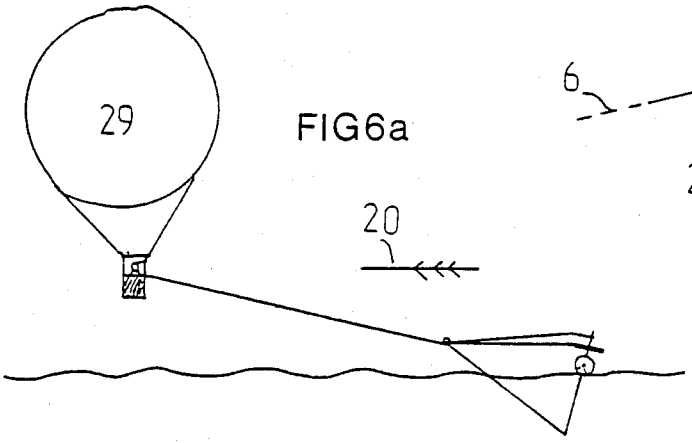
Figure 6B:
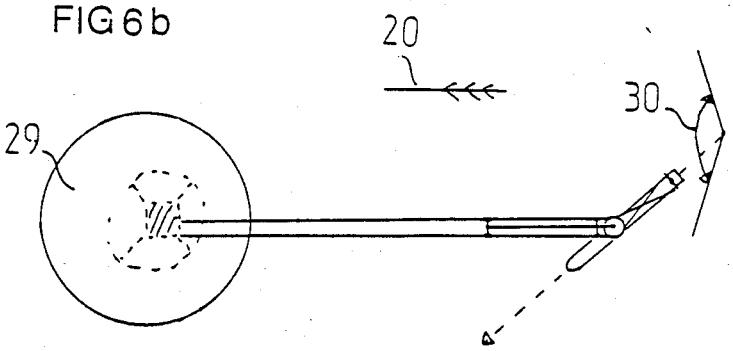

A drogue 1 in accordance with the invention may be associated with a lighter-than-air craft of the free balloon type (see FIGS. 6*a* and 6*b*). When a free balloon 29 is at low altitude above the waves, its route may be steered within a downwind sector 30 by means of a drogue 1. This facility may be used, for example, in order to direct it towards zones having a more favorable wind.

I claim:

1. A guidance system comprising:

a craft, a drogue towed by said craft, a rope connected to said drogue and said craft for towing said drogue, said drogue including a float, a centerboard, and steering means including a wheel connected to said rope, an axis of said wheel coinciding with a yaw axis of said float and said drogue having static stability about its center of gravity; and lateral stability about a roll axis of said float being provided by means of an arm which is free to rotate about said axis of said wheel and an end of said arm being connected to said centerboard by a length of cord.

2. A drogue according to claim 1, wherein said wheel rotates freely about said axis through a deflection limited by stops and steers said float by a steering gear so that said drogue steers along the direction given by said wheel.

3. A drogue according to claim 1, wherein transmitter means and receiver means are supported by said float.

4. A drogue according to claim 1, wherein said rope run around said wheel and is fixed to said wheel at a point which lies in the longitudinal plane of said float when said wheel is in a neutral position.

5. A guidance system comprising:

a boat having a superstructure, a drogue, a rope interconnecting said superstructure and said drogue for towing of said drogue by said boat, said drogue including a float, a centerboard, and steering means including a wheel, an axis of said wheel coinciding with a yaw axis of said float, and said drogue having static stability about its center of gravity, said wheel being rotated as a function of the degree to which said boat heels by positioning two portions of said rope on said superstructure at different heights.

6. A guidance system comprising:

a boat having a superstructure, a drogue, a roper interconnecting said superstructure and said drogue for towing of said drogue by said boat, said drogue including a float, a centerboard, and steering means including a wheel, an axis of said wheel coinciding with a yaw axis of said float, and said drogue having static stability about its center of gravity, means for varying the positioning said rope on said superstructure including two supports which are free to move substantially vertically, with said supports being interconnected by a length of cord which passes over a pulley at the top of said superstructure and being operated from said boat by control lines.

7. A guidance system as in claim 6, wherein said supports are movable in vertical slides.

* * * * *

UNITED STATES PATENT AND TRADEMARK OFFICE

CERTIFICATE OF CORRECTION

PATENT NO. : 4,798,157

DATED : January 17, 1989

INVENTOR(S) : Jean Duret

It is certified that error appears in the above-identified patent and that said Letters Patent is hereby corrected as shown below:

The title page should be deleted to appear as per attached sheet.

Signed and Sealed this

Ninth Day of October, 1990

*Attest:*

HARRY F. MANBECK, JR.

*Attesting Officer*

*Commissioner of Patents and Trademarks*

United States Patent [19]

Duret

[11] Patent Number: 4,798,157

[45] Date of Patent: Jan. 17, 1989

[54] DROGUE ASSOCIATED WITH A GUIDANCE SYSTEM

[76] Inventor: Jean Duret, 27 rue de la Double Haie, 60300 Senlis, France

[21] Appl. No.: 945,059

[22] PCT Filed: February 4, 1986

[86] PCT No.: PCT/FR86/00114

§ 371 Date: January 30, 1987

§ 102(e) Date: January 30, 1987

[87] PCT Pub. No.: WO 86/05757

PCT Pub. Date: October 9, 1986

[30] Foreign Application Priority Data

Apr. 2, 1985 [FR] France ..... 8504965

[51] Int. Cl.[4] ..... B63B 1/24

[52] U.S. Cl. ..... 114/253; 114/121; 114/122; 114/123; 114/246; 446/154

[58] Field of Search ..... 114/144 A, 144 R, 39, 114/56, 61, 121, 122, 123, 242, 253, 128, 246, 311; 446/153, 154, 155, 34, 31

[56] References Cited

U.S. PATENT DOCUMENTS

| | | | |
|---|---|---|---|
| 1,859,557 | 5/1932 | Edgar | 446/154 |
| 1,893,149 | 1/1933 | Picco | 244/3 |
| 2,834,152 | 5/1958 | Lambert | 446/154 |
| 3,008,442 | 11/1961 | Russell | 114/128 |
| 3,745,958 | 7/1973 | Nelson | 114/253 |
| 3,762,353 | 10/1973 | Shutt | 114/39 |
| 3,793,761 | 2/1974 | Bonham | 446/154 |
| 3,870,004 | 3/1975 | Bailey | 114/39 |
| 3,953,905 | 5/1976 | Paitson | 114/253 |
| 4,067,280 | 1/1978 | Serfess | 114/128 |
| 4,345,535 | 8/1982 | Ross | 114/128 |

FOREIGN PATENT DOCUMENTS

| | | | |
|---|---|---|---|
| 1494784 | 9/1967 | France | 114/39 |
| 2519311 | 7/1983 | France | 114/39 |
| 2526749 | 11/1983 | France | 114/39 |

*Primary Examiner*—Joseph F. Peters, Jr.
*Assistant Examiner*—C. T. Bartz
*Attorney, Agent, or Firm*—Fleit, Jacobson, Cohn & Price

[57] ABSTRACT

The drogue (1) has a steering system (8) which may be assisted by a rudder (4). The drogue is steered by varying the towing angle by applying a longitudinal differential force to the rope (6). The drogue is highly stable. It is capable of effectively countering the heeling torque of a boat (5). It may also be used for performing experiments at a distance from acoustic interference from the towing vessel. It may also be used for steering the course of a free balloon above the waves within a downwind sector.

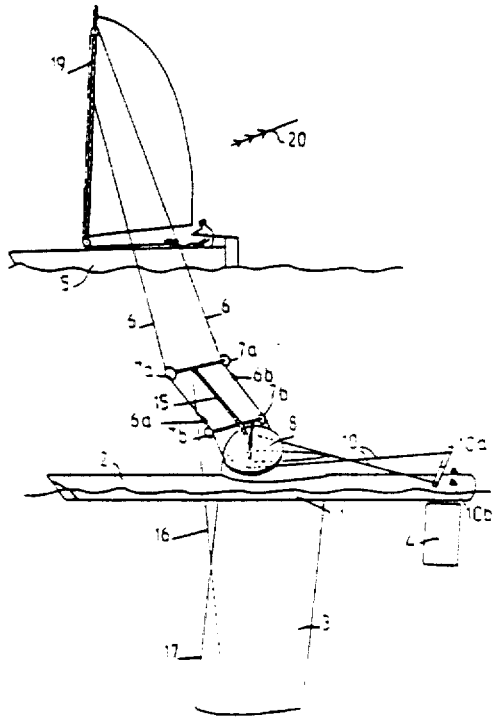

7 Claims, 3 Drawing Sheets